US008816924B2

(12) United States Patent
Wong et al.

(10) Patent No.: US 8,816,924 B2
(45) Date of Patent: Aug. 26, 2014

(54) COMMUNICATION DEVICE AND ANTENNA STRUCTURE THEREIN

(75) Inventors: Kin-Lu Wong, Kaohsiung (TW); Fang-Hsien Chu, Kaohsiung (TW)

(73) Assignee: Acer Incorporated, Taipei Hsien (TW)

( * ) Notice: Subject to any disclaimer, the term of this patent is extended or adjusted under 35 U.S.C. 154(b) by 158 days.

(21) Appl. No.: 13/425,316

(22) Filed: Mar. 20, 2012

(65) Prior Publication Data

US 2013/0169497 A1 Jul. 4, 2013

(30) Foreign Application Priority Data

Dec. 28, 2011 (TW) ..... 100149114 A

(51) Int. Cl.
*H01Q 13/10* (2006.01)
*H01Q 1/24* (2006.01)

(52) U.S. Cl.
CPC ..... *H01Q 13/10* (2013.01); *H01Q 1/243* (2013.01)
USPC ..... 343/767; 343/702

(58) Field of Classification Search
CPC ..... H01Q 13/10; H01Q 1/243; H01Q 9/42; H01Q 9/40
USPC ..... 343/700 MS, 767, 702
See application file for complete search history.

(56) References Cited

U.S. PATENT DOCUMENTS 7,642,981 B2 * 1/2010 Kanno et al. ..... 343/767
2003/0193437 A1 * 10/2003 Kangasvieri et al. ..... 343/702
2010/0188294 A1 7/2010 Chung et al.
2012/0206301 A1 * 8/2012 Flores-Cuadras et al. .... 343/700 MS
2012/0326943 A1 * 12/2012 Flores-Cuadras et al. .... 343/893
2013/0229317 A1 * 9/2013 Mumbru et al. ..... 343/767

FOREIGN PATENT DOCUMENTS

WO WO 2009/085406 7/2009
WO WO 2010/010529 1/2010

OTHER PUBLICATIONS

European Search Report dated Dec. 13, 2012.

* cited by examiner

*Primary Examiner* — Hoanganh Le

(74) *Attorney, Agent, or Firm* — McClure, Qualey & Rodack, LLP

(57) ABSTRACT

A communication device includes an antenna structure, wherein the antenna structure includes a ground element and an antenna element. One edge of the ground element has a notch, and the notch is extended into the interior of the ground element to form a slot region. The slot region is substantially extended along the edge of the ground element. The antenna element includes a first radiating portion and a second radiating portion. The first radiating portion is disposed in the slot region and is excited to form at least a resonant mode in the first operating band of the antenna element. The second radiating portion is an open-slot antenna and is formed by the slot region. The second radiating portion is excited to form a resonant mode in the second operating band of the antenna element.

18 Claims, 5 Drawing Sheets

COMMUNICATION DEVICE AND ANTENNA STRUCTURE THEREIN

CROSS REFERENCE TO RELATED APPLICATIONS

This application claims priority of Taiwan Patent Application No. 100149114 filed on Dec. 28, 2011, the entirety of which is incorporated by reference herein.

BACKGROUND OF THE INVENTION

1. Field of the Invention

The disclosure generally relates to a communication device and an antenna structure therein, and more particularly, relates to a communication device and an antenna structure for combining an open-slot antenna and a monopole antenna that are excited to form a low frequency band and a high frequency band, respectively. By disposing a notch of the open-slot antenna toward a short edge of a ground element of the communication device, the communication device and the antenna structure therein can reduce influence of a hand of a user on antenna performance.

2. Description of the Related Art

With progress in the mobile communication industry, mobile communication devices have become smaller and thinner; therefore, antennas applied in the mobile communication devices are integrated with nearby elements and be operated to cover wider frequency bands. With respect to traditional antenna designs, an antenna element requires a clearance space on a system circuit board, and the clearance space cannot be utilized again by other elements. This limits the use of the space on the system circuit board, and it is difficult to minimize the antenna element. Further, when a mobile communication device is used, disposition of the antennas determines how the mobile communication device is influenced by a hand of a user. For example, U.S. Pat. No. 7,768,466 B2, "Multiband folded loop antenna", discloses an antenna of a mobile phone that occupies a three-dimensional space. The antenna of the mobile phone is disposed on an edge of a ground plane, and occupies the whole edge of the ground plane so as to cover wider frequency bands. The antenna of the mobile phone cannot be closely integrated with the surrounding ground plane; therefore, the inner space of the mobile phone is wasted. In addition, since the clearance space on which the antenna of the mobile phone is disposed cannot be incorporated with other radiating elements excited to form other resonant modes, the antenna of the mobile phone cannot cover more operating bands. While a user is using a mobile communication device including the antenna, radiation performance of the antenna tends to be influenced by different hand positions of a user.

BRIEF SUMMARY OF THE INVENTION

The invention is designed for providing a communication device and an antenna structure therein, combining a monopole antenna and an open-slot antenna formed by the clearance space of the monopole antenna. The monopole antenna and the open-slot antenna are both excited to form resonant modes so that the antenna structure can cover more operating bands. In addition, the clearance space on a system circuit board can be utilized efficiently. The invention also reduces the influence of a hand of a user on the antenna performance.

In one exemplary embodiment, the disclosure is directed to a communication device comprising an antenna structure, the antenna structure comprising: a ground element disposed on a dielectric substrate, wherein an edge of the ground element has a notch extending into an interior of the ground element to form a slot region, the slot region substantially extends along the edge of the ground element, and a width of the slot region is greater than a length of the notch along the edge of the ground element; and an antenna element disposed on the dielectric substrate, the antenna element comprising: a first radiating portion disposed in the slot region, wherein the first radiating portion is excited to form at least a resonant mode in a first operating band (higher frequency band) of the antenna element; and a second radiating portion, wherein the second radiating portion is an open-slot antenna and is formed by the slot region, and the second radiating portion is excited to form a resonant mode in a second operating band (lower frequency band) of the antenna element.

In another embodiment, the disclosure is directed to an antenna structure comprising: a ground element disposed on a dielectric substrate, wherein an edge of the ground element has a notch extending into an interior of the ground element to form a slot region, the slot region substantially extends along the edge of the ground element, and a width of the slot region is greater than a length of the notch along the edge of the ground element; and an antenna element disposed on the dielectric substrate, the antenna element comprising: a first radiating portion disposed in the slot region, wherein the first radiating portion is excited to form at least a resonant mode in a first operating band (higher frequency band) of the antenna element; and a second radiating portion, wherein the second radiating portion is an open-slot antenna and is formed by the slot region, and the second radiating portion is excited to form a resonant mode in a second operating band (lower frequency band) of the antenna element.

In an embodiment of the invention, the first radiating portion may be a monopole antenna, and a feeding point of the first radiating portion is the feeding point of the antenna element. The first radiating portion may serve as a feeding portion of the second radiating portion so as to excite the open-slot antenna. In addition, the length of the notch along the edge of the ground element is smaller than one-fourth of the length of the slot region. The distance between the slot region and the edge of the ground element is smaller than 3 mm. A metal element is disposed on the edge of the ground element. The metal element is substantially perpendicular to the ground element, and is electrically coupled to the edge of the ground element. The height of the metal element disposed on the ground element is smaller than 5 mm. The invention provides a communication device and an antenna structure therein that may be applied in a thin mobile communication device. Each of the first and second operating bands of the antenna element can cover at least a mobile communication band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures thereof in the invention are shown in detail as follows.

Figure 1:
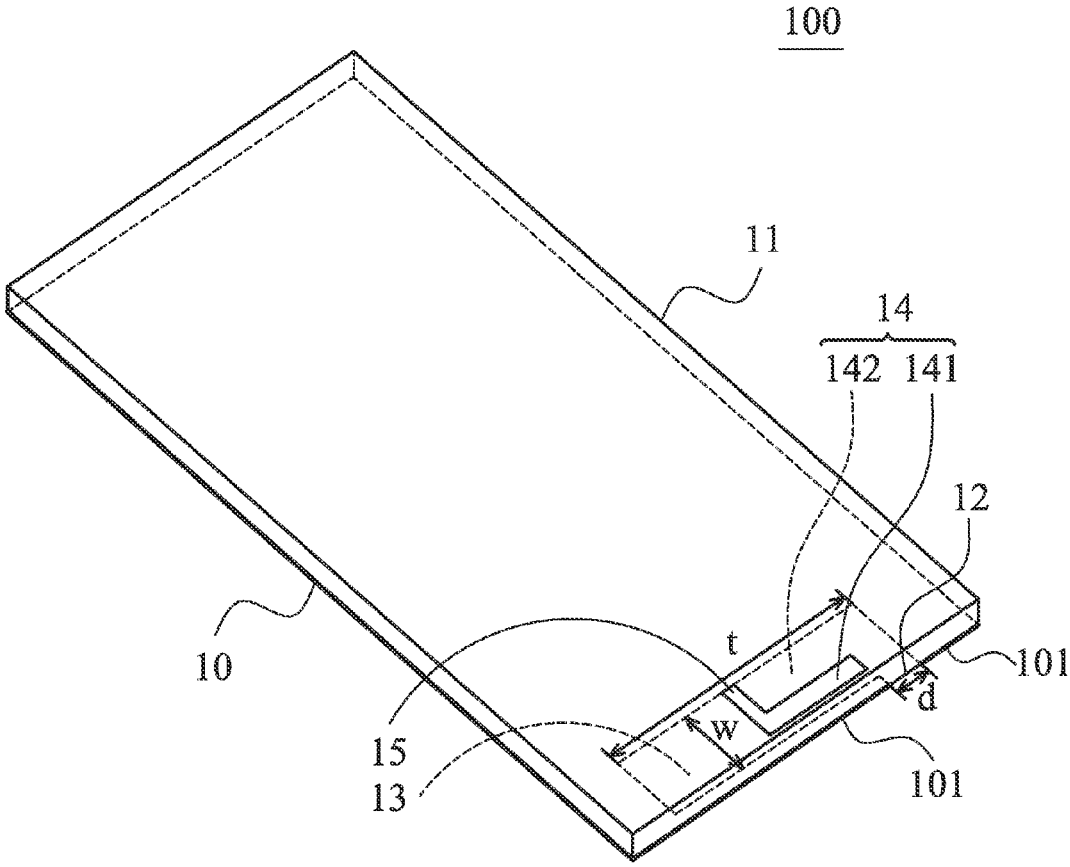
FIG. 1 is a diagram for illustrating a communication device and an antenna structure therein according to a first embodiment of the invention.

FIG. 1 is a diagram for illustrating a communication device 100 and an antenna structure therein according to a first embodiment of the invention. In the embodiment, the communication device 100 and the antenna structure therein comprise a ground element 10 and an antenna element 14, wherein the ground element 10 is disposed on a dielectric substrate 11. An edge 101 of the ground element 10 has a notch 12, which extends into an interior of the ground element 10 so as to form a slot region 13. The slot region 13 substantially extends along the edge 101 of the ground element 10. The width w of the slot region 13 is greater than a length d of the notch 12 along the edge 101 of the ground element 10. The antenna element 14 is disposed on the dielectric substrate 11, and comprises a first radiating portion 141 and a second radiating portion 142. The first radiating portion 141 is disposed in the slot region 13 and is excited to form at least a resonant mode in a first operating band (higher frequency band) of the antenna element 14. The second radiating portion 142 is an open-slot antenna and is formed by the slot region 13. The second radiating portion 142 is excited to form a resonant mode in a second operating band (lower frequency band) of the antenna element 14. It is noted that the edge 101 where the notch 12 is disposed is a short edge of the ground element 10, and the notch 12 is away from the two corners of the short edge. Therefore, influence of a hand of a user on the antenna structure can be reduced when the user holds the communication device 100 of the invention in his hand.

Figure 2:
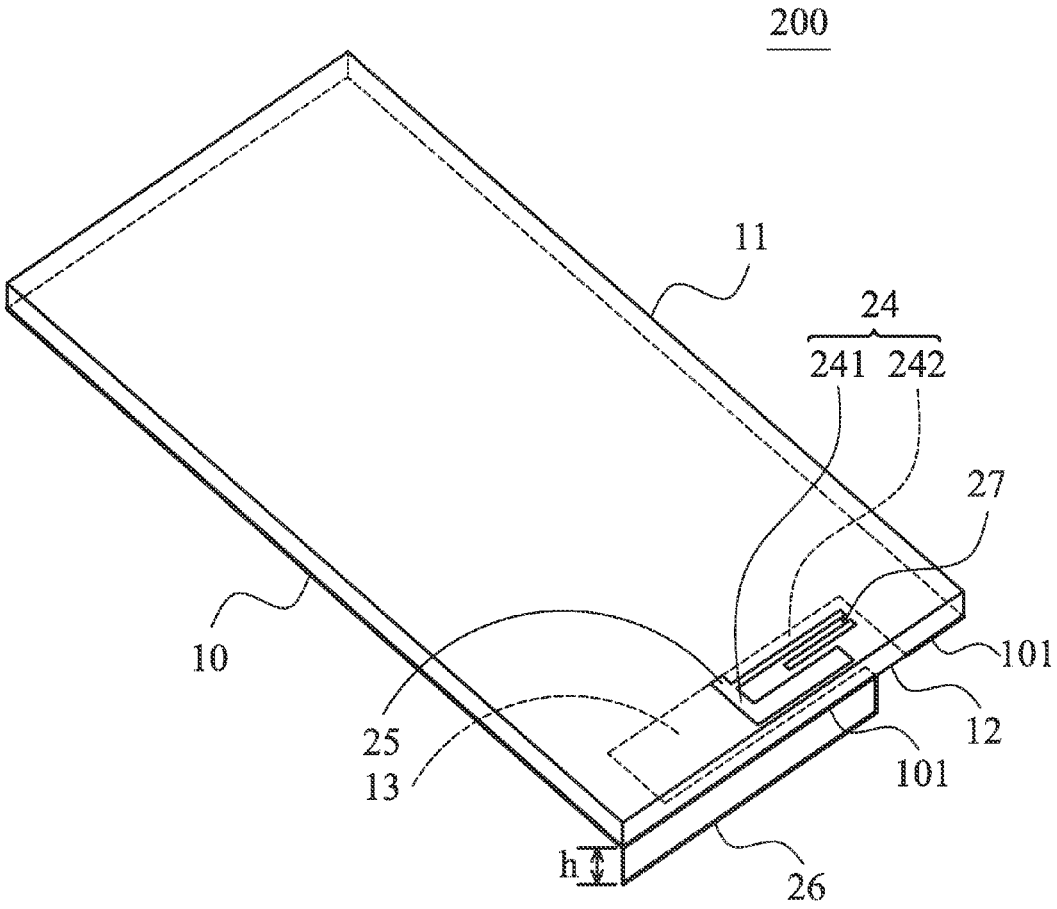
FIG. 2 is a diagram for illustrating a communication device and an antenna structure therein according to a second embodiment of the invention.

FIG. 2 is a diagram for illustrating a communication device 200 and an antenna structure therein according to a second embodiment of the invention. The communication device 200 and the antenna structure therein in the second embodiment are different from the communication device 100 and the antenna structure therein in the first embodiment, and the difference between them is illustrated as follows. A first radiating portion 241 is a monopole antenna with two branches. By incorporating an inductive element 27 into one branch of the monopole antenna, the first radiating portion 241 can be excited to form two resonant modes in a high frequency band and a low frequency band, respectively, so as to increase bandwidths of the first operating band (higher frequency band) and the second operating band (lower frequency band). It is noted that the first radiating portion 241 may comprise a plurality of inductive elements 27. The communication device 200 and the antenna structure therein may further comprise a metal element 26. The metal element 26 is substantially perpendicular to the ground element 10 and is electrically coupled to the edge 101 of the ground element 10. The communication device 200 and the antenna structure therein are similar to the communication device 100 and the antenna structure therein. Therefore, the performance of the second embodiment is similar to that of the first embodiment.

Figure 3:
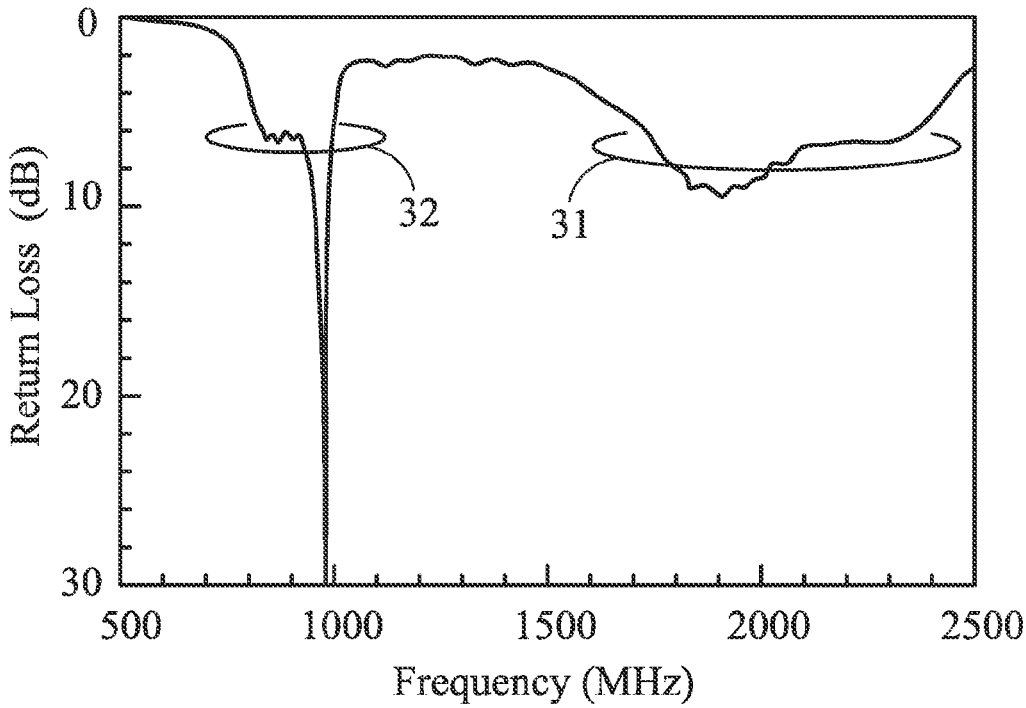
FIG. 3 is a diagram for illustrating return loss of the communication device and the antenna structure therein according to the second embodiment of the invention.

FIG. 3 is a diagram for illustrating return loss of the communication device 200 and the antenna structure therein according to the second embodiment of the invention, wherein the vertical axis represents the return loss (unit: dB), and the horizontal axis represents frequency (unit: MHz). In the embodiment, the dielectric substrate 11 is approximately 115 mm in length and 60 mm in width and 0.8 mm in thickness. The ground element 10 is disposed on the dielectric substrate 11. The width d of the notch 12 of the ground element 10 is approximately 3 mm. The slot region 13 formed by the ground element 10 and the notch 12 has a length t that is approximately equal to 0.14 times the wavelength of the central frequency (about 900 MHz) of the second operating band 32 (lower frequency band), and the length t of the slot region 13 is smaller than one-fourth the wavelength of the central frequency of the second operating band 32. The metal element 26 is approximately 3 mm in height and 50 mm in length. According to the measurement, the first operating band 31 covers at least three frequency bands of GSM1800/1900/UMTS (1710 MHz-2170 MHz), and the second operating band 32 covers at least two frequency bands of GSM850/900 (824 MHz-926 MHz), based on the 6-dB return-loss bandwidth definition (the design specification of the mobile communication device antennas). Therefore, the invention can cover the penta-band WWAN operation.

Figure 4:
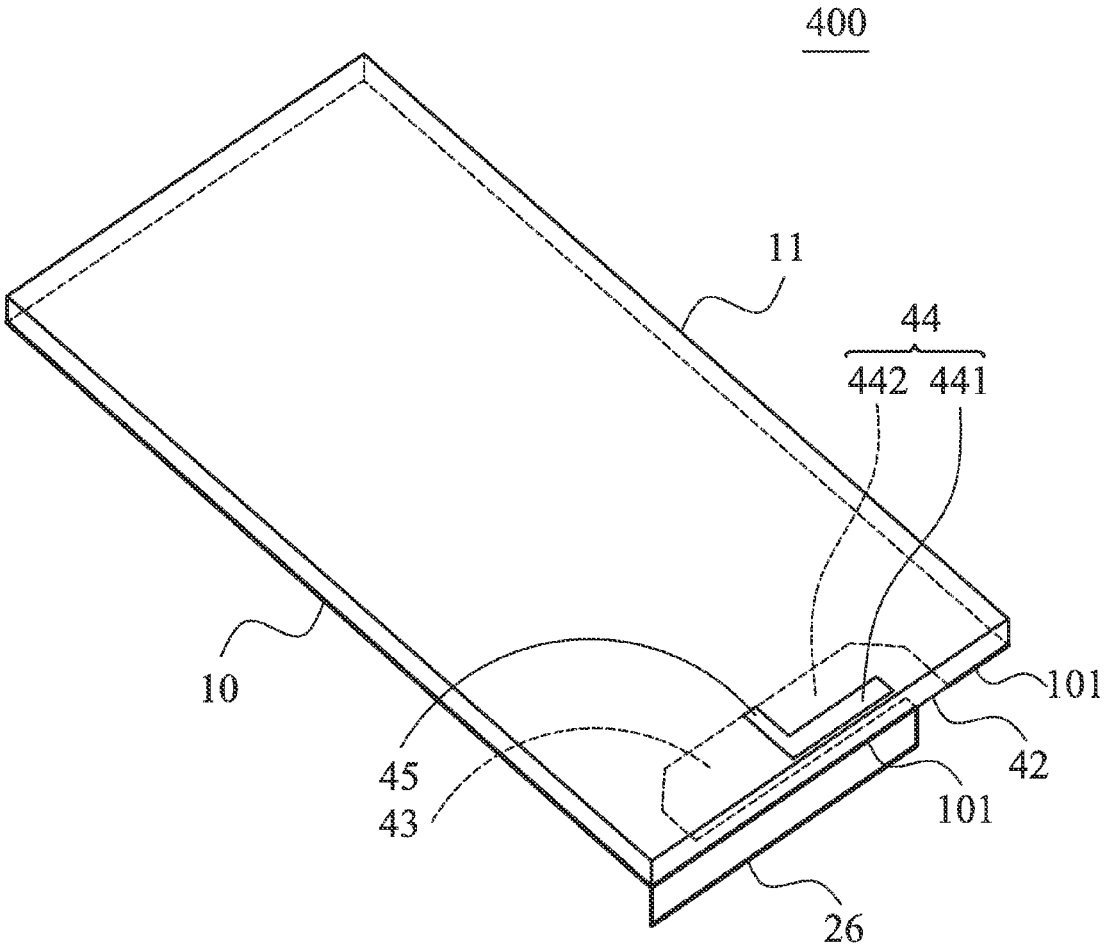
FIG. 4 is a diagram for illustrating a communication device and an antenna structure therein according to a third embodiment of the invention.

FIG. 4 is a diagram for illustrating a communication device 400 and an antenna structure therein according to a third embodiment of the invention. The communication device 400 and the antenna structure therein in the third embodiment are basically similar to the communication device 100 and the antenna structure therein in the first embodiment. The main difference between them is that a second radiating portion 442 of the communication device 400 and the antenna structure therein may be a polygon slot, and the metal element 26 is electrically coupled to the edge 101 of the ground element 10. The communication device 400 and the antenna structure therein in the third embodiment may also be excited to form two wide operating bands similar to those in the first embodiment by adjusting the length and the width of a first radiating portion 441 and by adjusting the length of a notch 42 so as to adjust the excited resonant modes and their impedance matching. Therefore, the communication device 400 and the antenna structure therein can cover the penta-band WWAN operation.

Figure 5:
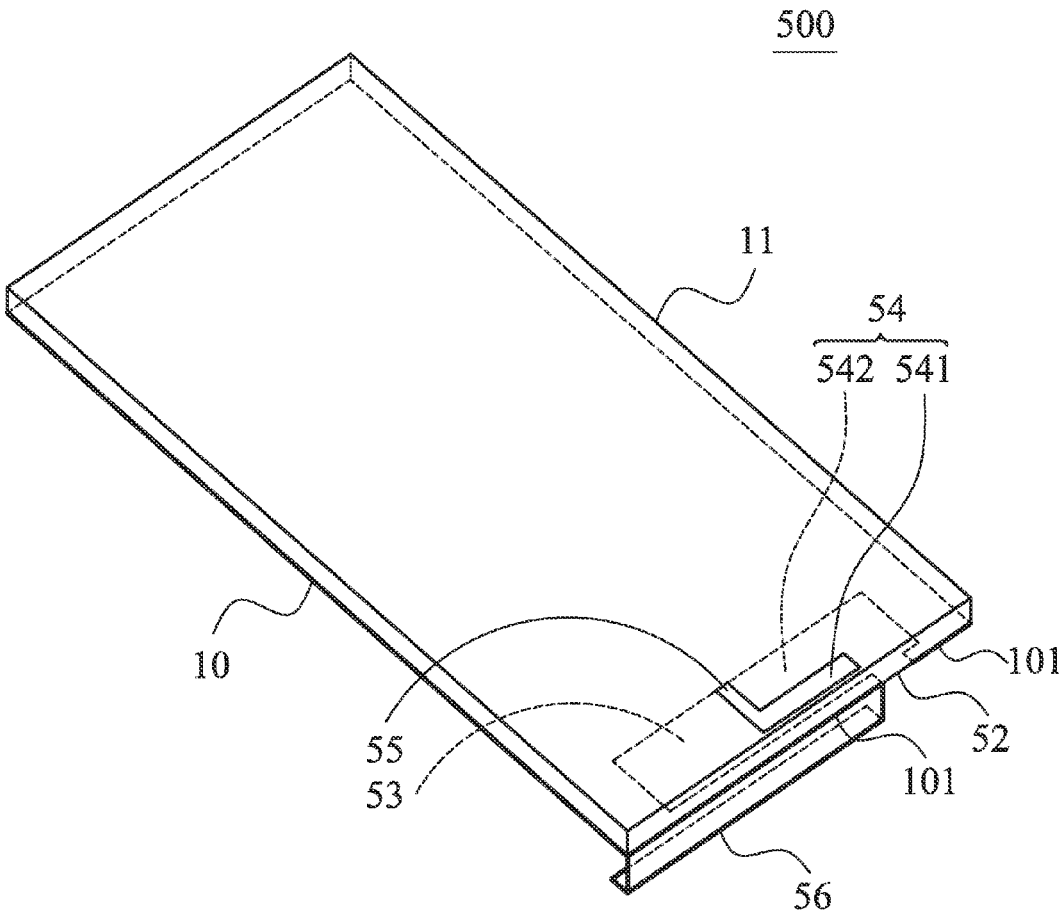
FIG. 5 is a diagram for illustrating a communication device and an antenna structure therein according to a fourth embodiment of the invention.

FIG. 5 is a diagram for illustrating a communication device 500 and an antenna structure therein according to a fourth embodiment of the invention. The communication device 500 and the antenna structure therein in the fourth embodiment are basically similar to the communication device 100 and the antenna structure therein in the first embodiment. The main difference between them is that a metal element 56 of the communication device 500 and the antenna structure therein has a bending, which is configured to increase a size of the metal element 56 so as to improve the impedance matching of an antenna element 54. The communication device 500 and the antenna structure therein in the fourth embodiment may also be excited to form two wide operating bands similar to those in the first embodiment. Therefore, the communication device 500 and the antenna structure therein can cover the penta-band WWAN operation.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device comprising an antenna structure, the antenna structure comprising:

a ground element disposed on a dielectric substrate, wherein an edge of the ground element has a notch extending into an interior of the ground element, wherein a slot region is formed in the ground element and is connected to the notch, the slot region substantially extends along the edge of the ground element and has a distance to the edge of the ground element, and a width of the slot region is greater than a length of the notch along the edge of the ground element, wherein the width of the slot region is greater than two times the distance of the slot region to the edge of the ground element; and an antenna element disposed on the dielectric substrate and comprising:

a first radiating portion disposed in the slot region, wherein the first radiating portion is excited to form at least a resonant mode in a first operating band (higher frequency band) of the antenna element, wherein the first radiating portion is disposed on a first surface of the dielectric substrate, the ground element is disposed on a second surface of the dielectric substrate, the first surface is opposite to the second surface, the first radiating portion has a projection on the second surface, and the whole projection is on the inside of the slot region; and a second radiating portion, wherein the second radiating portion is an open-slot antenna and is formed by the slot region, and the second radiating portion is excited to form a resonant mode in a second operating band (lower frequency band) of the antenna element.

2. The communication device as claimed in claim 1, wherein the first radiating portion is a monopole antenna.

3. The communication device as claimed in claim 2, wherein the monopole antenna comprises two branches.

4. The communication device as claimed in claim 3, wherein one of the branches comprises an inductive element.

5. The communication device as claimed in claim 1, wherein a distance between the slot region and the edge of the ground element is smaller than 3 mm.

6. The communication device as claimed in claim 1, wherein the length of the notch along the edge of the ground element is smaller than one-fourth of a length of the slot region.

7. The communication device as claimed in claim 1, further comprising:

a metal element being substantially perpendicular to the ground element and electrically coupled to the edge of the ground element.

8. The communication device as claimed in claim 7, wherein a height of the metal element disposed on the ground element is smaller than 5 mm.

9. The communication device as claimed in claim 1, wherein the first radiating portion further comprises at least one inductive element.

10. An antenna structure comprising:

a ground element disposed on a dielectric substrate, wherein an edge of the ground element has a notch extending into an interior of the ground element, wherein a slot region is formed in the ground element and is connected to the notch, the slot region substantially extends along the edge of the ground element and has a distance to the edge of the ground element, and a width of the slot region is greater than a length of the notch along the edge of the ground element, wherein the width of the slot region is greater than two times the distance of the slot region to the edge of the ground element; and an antenna element disposed on the dielectric substrate and comprising:

a first radiating portion disposed in the slot region, wherein the first radiating portion is excited to form at least a resonant mode in a first operating band (higher frequency band) of the antenna element, wherein the first radiating portion is disposed on a first surface of the dielectric substrate, the ground element is disposed on a second surface of the dielectric substrate, the first surface is opposite to the second surface, the first radiating portion has a projection on the second surface, and the whole projection is on the inside of the slot region; and a second radiating portion, wherein the second radiating portion is an open-slot antenna and is formed by the slot region, and the second radiating portion is excited to form a resonant mode in a second operating band (lower frequency band) of the antenna element.

11. The antenna structure as claimed in claim 10, wherein the first radiating portion is a monopole antenna.

12. The antenna structure as claimed in claim 11, wherein the monopole antenna comprises two branches.

13. The antenna structure as claimed in claim 12, wherein one of the branches comprises an inductive element.

14. The antenna structure as claimed in claim 10, wherein a distance between the slot region and the edge of the ground element is smaller than 3 mm.

15. The antenna structure as claimed in claim 10, wherein the length of the notch along the edge of the ground element is smaller than one-fourth of a length of the slot region.

16. The antenna structure as claimed in claim 10, further comprising:

a metal element being substantially perpendicular to the ground element and electrically coupled to the edge of the ground element.

17. The antenna structure as claimed in claim 16, wherein a height of the metal element disposed on the ground element is smaller than 5 mm.

18. The antenna structure as claimed in claim 10, wherein the first radiating portion further comprises at least one inductive element.

* * * * *